US006542348B1

(12) United States Patent
Stupak, Jr.

(10) Patent No.: US 6,542,348 B1
(45) Date of Patent: Apr. 1, 2003

(54) METHOD AND SYSTEM FOR DRIVING A MAGNETIZING FIXTURE

(76) Inventor: Joseph J. Stupak, Jr., 7102 SW. 10th Ave., Portland, OR (US) 97219

( * ) Notice: Subject to any disclaimer, the term of this patent is extended or adjusted under 35 U.S.C. 154(b) by 0 days.

(21) Appl. No.: 09/404,922

(22) Filed: Sep. 24, 1999

Related U.S. Application Data

(63) Continuation-in-part of application No. 09/018,209, filed on Feb. 3, 1998.

(51) Int. Cl.[7] ..... H01H 47/00
(52) U.S. Cl. ..... 361/147; 361/156; 335/284
(58) Field of Search ..... 361/143, 147, 361/152, 155, 156, 170, 189–190, 206, 159, 149–151, 267, 154; 335/284

(56) References Cited

U.S. PATENT DOCUMENTS 4,039,853 A * 8/1977 Koizumi et al. ..... 307/101
4,354,218 A * 10/1982 Steingroever et al. ..... 361/147
4,497,011 A * 1/1985 Hurtig ..... 361/147
4,757,419 A * 7/1988 Masaki ..... 361/156
4,845,370 A * 7/1989 Thompson et al. ..... 250/492.3
5,017,789 A * 5/1991 Young et al. ..... 250/396 ML
5,111,123 A * 5/1992 Hach et al. ..... 318/434
5,373,201 A * 12/1994 Pinder et al. ..... 307/113

* cited by examiner

*Primary Examiner*—Kim Huynh
(74) *Attorney, Agent, or Firm*—Birdwell, Janke & Durando, PLC

(57) ABSTRACT

A method and system for driving a magnetizing fixture. A driving circuit produces in the conductor of a magnetizing fixture a first current whose magnitude increases substantially linearly with time, then produces a substantially constant current in the same direction, then produces a current in the same direction whose magnitude decreases substantially linearly with time, thereby forming a substantially trapezoidal magnetization current waveform having symmetrical sides. The circuit comprises a first energy storage device for supplying electrical energy to the magnetizing fixture, a second energy storage device for receiving electrical energy from the magnetizing fixture, and a commutator interconnecting the first energy storage device, the second energy storage device and the magnetizing fixture for stopping the flow of electrical energy into the magnetizing fixture from the first energy storage device and starting the flow of energy from the magnetizing fixture into the second energy storage device.

4 Claims, 7 Drawing Sheets

Fig. 2A
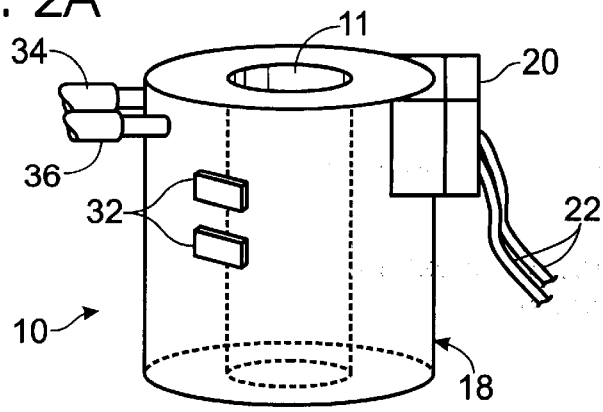
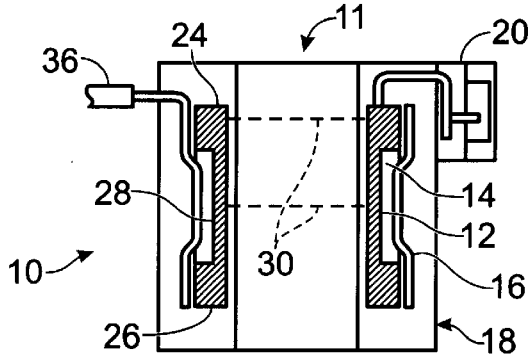
Fig. 2B
Fig. 3
(PRIOR ART)
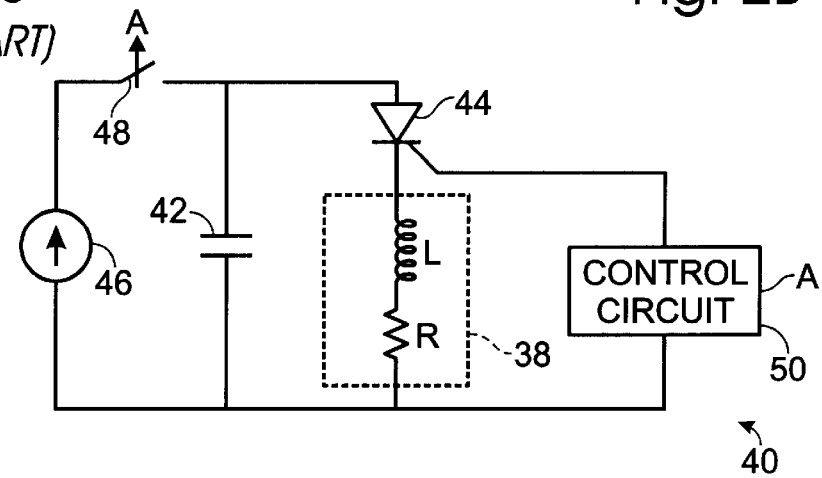
Fig. 4A
(PRIOR ART)
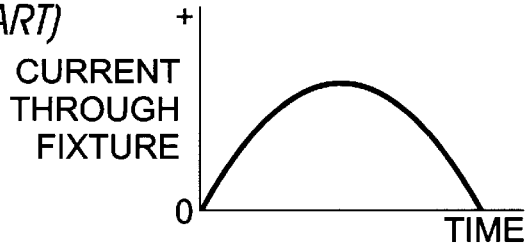

t1
t3
t2
+
v1
VOLTAGE ACROSS C1

+
v3
VOLTAGE ACROSS C3
0
v4
v5
−

0
VOLTAGE ACROSS C2
v2
v6
−

+
ΔI
CURRENT THROUGH FIXTURE
0

+
VOLTAGE ACROSS FIXTURE
0
−

METHOD AND SYSTEM FOR DRIVING A MAGNETIZING FIXTURE

This is a continuation-in-part of the inventor's prior application Ser. No. 09/018,209, filed Feb. 3, 1998. This invention relates to methods and systems for producing permanent magnetic fields in magnetic material, and particularly to a method and system for driving a magnetizing fixture so as to maximize the efficiency and minimize the resistive heating thereof.

BACKGROUND OF THE INVENTION

Permanent magnets of the type used in electric motors, linear actuators and the like are created by magnetizing magnetically hard materials. This type of magnetization is usually accomplished by placing the material within a high intensity magnetic field which is created by passing a very high electric current pulse through a coil or coil-pole structure usually called a magnetizing fixture. The current pulse is created by the sudden release of charge stored in an energy storage device such as a bank of capacitors. The high current pulse resulting from the sudden release of the charge passes through the windings of the magnetic fixture and causes a brief but very strong magnetic field which, in turn, causes the magnetic domains within the magnetically permeable material to align in the required pattern. This alignment is achieved within the material in a very brief period of time (less than a few millionths of a second). Once the magnetic field of the fixture collapses, the material remains permanently magnetized.

Magnetizing fixtures typically comprise coils of an electrical conductor whose windings are separated from one another and from other parts of the fixture by an insulator. The insulator may comprise solid insulating material, such as a dielectric lacquer coating on the conductor, or simply the air separating the windings and other parts. In any case, the insulator has a breakdown voltage which, if exceeded, will at least prevent proper operation of the magnetizing fixture and usually destroy or damage solid insulation. This limits the rate at which the current in the conductor may change, the voltage on the conductor being proportional to the rate of change of current through the conductor.

When current passes through a conductor, the resistance of the conductor results in an energy loss, which produces heat. That energy loss, and concomitant heat, is proportional to the integral of the square of the current through the conductor with respect to time. Not only does the energy that is converted to heat represent energy that cannot be used for magnetization, but the heat produced by this power loss can damage the fixture, particularly any solid insulation that is employed therein. Therefore, to reduce heating of the fixture, it is desirable to keep the current pulse through the conductor of the fixture as short as possible.

It can be shown that, to meet the conflicting goals of keeping the voltage on the conductor of the magnetizing fixture below the insulation breakdown voltage and keeping the magnetization current pulse as short as possible, the current produced by the magnetizing pulse should increase and decrease linearly with time. It can also be shown that it is desirable to hold the maximum current for a brief period of time to overcome eddy currents, if present. Since the voltage across the magnetizing fixture is proportional to $Ldi/dt-iR$, where L is the inductance of the fixture and R is the resistance of the fixture, the ideal magnetization current pulse would be one that has a trapezoidal shape, the increase in current to its maximum and the decrease in current to its minimum being linear so as to produce a constant voltage on the conductor that is less than the breakdown voltage.

Known prior art methods and systems have not been able to achieve a substantial approximation of the ideal magnetization current waveform. While there are circuits available for producing a signal having a triangular shaped waveform, and perhaps even a trapezoidal shaped waveform, none is known which is able to do so at the current levels necessary for driving a magnetizing fixture, that is, hundreds to thousands of amperes. Those known circuits for driving a magnetizing fixture produce magnetization waveforms whose rate of change of current changes significantly over the time of the magnetization pulse so as to produce voltage peaks that must be kept below the breakdown voltage of the insulation of the fixture. The effect of having to keep the voltage peaks below the breakdown voltage is to limit the amount of magnetization current that can be supplied to the magnetizing fixture, and thereby limit the amount of magnetization that can be produced in a permanent magnet. This is because, to avoid overheating, the magnetization current pulse cannot be applied long enough to reach the maximum possible current.

Therefore, there has been a need for a method and system for driving a magnetizing fixture so as to produce a substantially triangular magnetization current waveform reaching a peak current in excess of 100 amperes.

SUMMARY OF THE INVENTION

The present invention meets the aforementioned need by providing a method and system that produces in the conductor of a magnetizing fixture for a first period of time a first current of whose magnitude increases substantially linearly with time to a peak value of at least 100 amperes, and thereafter produces in the conductor of the magnetizing fixture for a second period of time a second current in the same direction as said first current whose magnitude decreases substantially linearly with time. The sum of the first and second periods of time are typically less than about 0.1 seconds. The invention may provide in addition the production in the conductor of the magnetizing fixture of a third current in the same direction as first current whose magnitude is within a predetermined range of said magnitude of said first current at the end of said first period of time and before the second period of time, so as to provide a brief dwell time between the first and second periods of time to allow eddy currents in the fixture to die out. These three currents together form a substantially triangular magnetization current waveform that is trapezoidal having substantially symmetrical sides.

One circuit for driving a magnetizing fixture for producing the aforedescribed currents comprises a first energy storage device for supplying electrical energy to,the magnetizing fixture, a second energy storage device for receiving electrical energy from the magnetizing fixture, and a commutator interconnecting the first energy storage device, the second energy storage device and the magnetizing fixture for stopping the flow of electrical energy into the magnetizing fixture from the first energy storage device and starting the flow of energy from the magnetizing fixture into the second energy storage device. A third energy storage device is provided for supplying electrical energy to the magnetizing fixture after the first energy storage device but before the second energy storage device to commutate the first energy storage device off and supply current to the fixture while decreasing voltage across the magnetizing fixture to the point at which the second energy storage device begins to receive energy from the fixture.

The rate of change of current during the first and second periods of time is controlled to be the maximum possible without exceeding the breakdown voltage of insulation in the magnetizing fixture.

Accordingly, it is a principal object of this invention to provide a method and system for driving a magnetizing fixture wherein the maximum magnetic field can be produced with minimum generation of heat in the magnetizing fixture.

It is another object of this invention to provide a current pulse in a magnetizing fixture whose waveform is substantially triangular and reaches a peak current in excess of 100 amperes.

It is a further object of the invention to provide such a current pulse having a duration less than about 0.1 seconds.

The foregoing and other objectives, features and advantages of the invention will be more readily understood upon consideration of the following detailed description of the invention, taken in conjunction with the accompanying drawings.

BRIEF DESCRIPTION OF THE DRAWINGS

FIG. 2A is a pictorial view of an exemplary magnetizing fixture for use with the present invention.

FIG. 2B is a cross section of the magnetizing fixture of FIG. 2A.

FIG. 3 is a schematic diagram of a first prior art magnetizing fixture driving system.

FIG. 4A illustrates the magnetization current waveform produced by the prior art driving system of FIG. 3.

DETAILED DESCRIPTION OF THE INVENTION

The problem solved by the present invention is to produce a very high peak current for magnetizing an article in a manner that minimizes joule heating.

To magnetize the article, a magnetizing fixture is provided including an insulated conductor wound as a coil for producing a magnetic field as a function of the magnitude of the current. The current must reach a peak value to provide a peak magnetic field.

Joule heating results from ohmic losses in the conductor that are proportional to the integral of the square of the current as a function of time. To minimize joule heating, the current should be increased to its maximum value and returned to its minimum value as quickly as possible. However, the voltage induced in the conductor as a result of changing the current is L di/dt. This voltage must be kept below the maximum that can be tolerated by the insulation provided around the conductor, to prevent breakdown of the insulation and arcing to nearby conductors, or to adjacent windings of the same conductor. Moreover, to minimize joule heating, the time over which the current is manipulated, i.e., the period of the waveform, must also be minimized.

It has been found that a substantially triangular current waveform optimizes the aforementioned, conflicting requirements when driving a magnetizing fixture, where current values must rise to and fall from values in excess of 100 amperes and, further, must do so in a time period of less than about 0.1 second. That is, the current is increased from a zero value to a peak value of at least about 100 amperes substantially linearly and, upon reaching the peak value, is relatively immediately decreased substantially linearly back to the zero value, all in a period of less than about 0.1 seconds.

It has also been found that for some applications where eddy current generation, either in the article to be magnetized or in the fixture, is a problem, a trapezoidal variant of the substantially triangular waveform is preferable, wherein a relatively small dwell time is employed wherein the peak value of current is held for a time that is small in comparison with the period of the waveform, e.g., about 10% or less than 50%. This length of time is predetermined to provide for a desired amount of decay of the eddy currents.

Figure 1A:
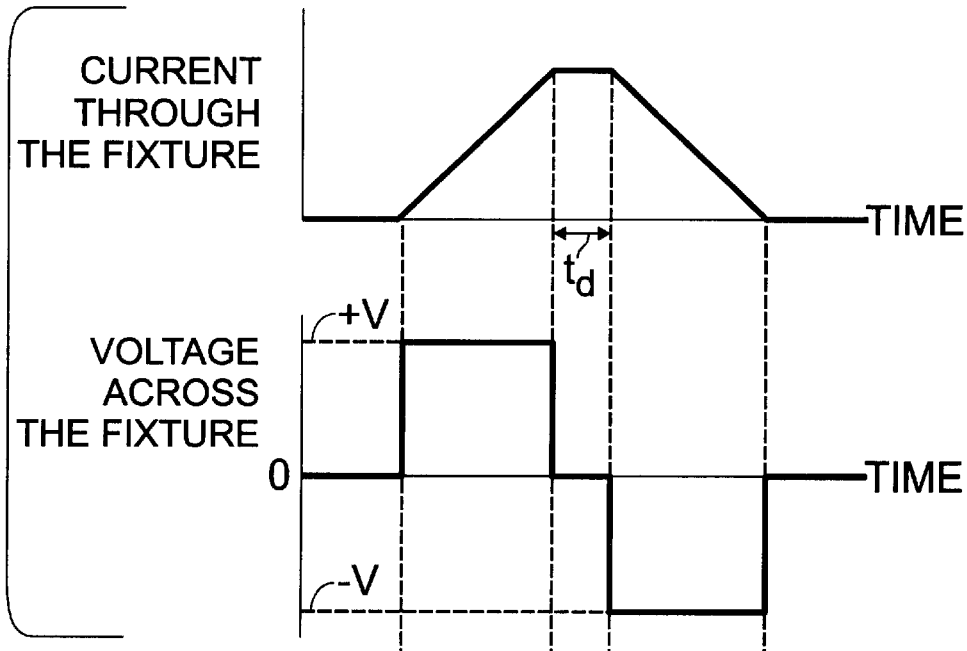
FIG. 1A shows companion plots of voltage and current for driving a magnetizing fixture according to the present invention.
Figure 1B:
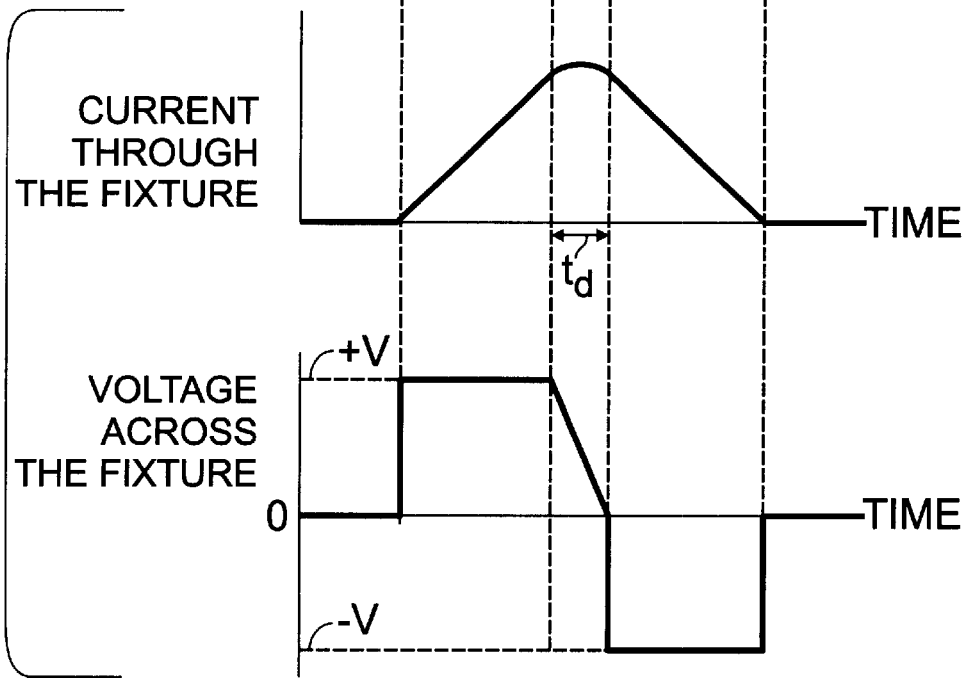
FIG. 1B shows companion plots of an alternative voltage and current for driving a magnetizing fixture according to the present invention.

Referring to FIG. 1A, ideal voltage and current waveforms are shown for driving the magnetizing fixture. The time delay $t_d$ during which the voltage is at its zero value is optional, to counter the aforementioned eddy current generation. Referring to FIG. 1B, showing alternative voltage and current waveforms, joule heating is not increased significantly if, over the time period $t_d$, the voltage is allowed to make some transition from its peak value to its zero value, e.g., a linear transition. In FIG. 1B, the transition is shown to be a straight line; however, the transition may have any shape so long as its duration is small in relation to the dwell time.

A typical magnetizing fixture of the type for use with the present invention is shown in FIGS. 2A and 2B. The fixture 10 comprises an electrically insulated conductor wound in a cylindrical coil 12, surrounded by reinforcing material 14 and cooling conduit 16, all packaged in an epoxy material 18. The fixture has a hole 11 through the center thereof for receiving an article to be magnetized.

The conductor of the coil 12 is typically a relatively large cross section wire insulated by a lacquer cover. The conductor is terminated in a connection box 20 to which a pair of heavy duty wires 22 from a driving circuit may be attached. The ends 24 and 26 of the coil may be thicker than the middle 28 so as to compensate for the otherwise reduced magnetic field density relative to the middle. The fixture may include a sense coil 30, terminated at contacts 32, for sensing the level of magnetic flux in the coil.

The reinforcing material 14 is typically a metal or fiberglass band which resists expansion of the coil 12 under the forces that occur when a large amount of current is discharged through the coil. The cooling conduit 16 typically terminates at a quick-connect inlet 34 and outlet 36 for receiving and discharging a cooling fluid to conduct out of the fixture the heat produced by the discharge of current.

It is to be appreciated, however, that a magnetizing fixture for use with the present invention could take many other forms. For example, more than one coil might be employed and the conductor might be insulated by air.

Two common prior art magnetizing fixture driving circuits, and the current and voltage waveforms they produce at the fixture, are shown in FIGS. 3–6. In these figures, as in the figures showing the present invention, a generic magnetizing fixture is denoted by 38 and it has a characteristic inductance L and a characteristic resistance R.

The circuit 40 of FIG. 3 is commonly known as a "bipolar" circuit. It comprises a capacitor 42 connected through a switching device, typically a silicon controlled rectifier ("SCR") 44, to the fixture 38. A charging circuit 46 is provided for charging the capacitor 42, and a control circuit 50 is provided for turning on switch 48 to charge the capacitor, and turning on the SCR to discharge the capacitor through the fixture 38.

Figure 4B:
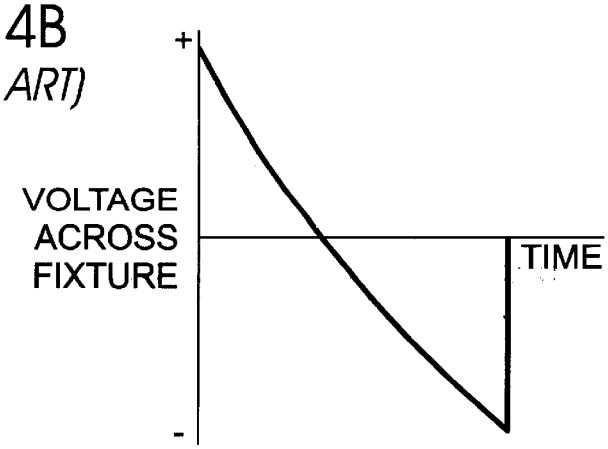
Fig. 4B (PRIOR ART)
FIG. 4B illustrates the voltage produced across the magnetizing fixture by the prior art driving system of FIG. 3.

When the SCR 44 turns on, the current through the fixture 38 varies as shown in FIG. 4A. The voltage across the fixture 38, varies as shown in FIG. 4B.

Figure 5:
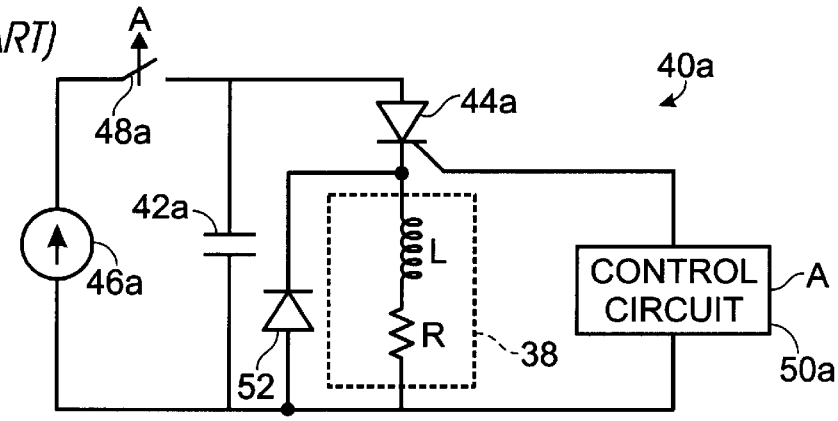
Fig. 5 (PRIOR ART)
FIG. 5 is a schematic diagram of a second prior art magnetizing fixture driving system.

The circuit 40*a* of FIG. 5 is known as a "unipolar" circuit. It comprises a capacitor 42*a* connected through a SCR switching device 44*a* to the fixture 38. A charging circuit 46*a* is provided for charging the capacitor 42*a*, and a control circuit 50*a* is provided for turning on switch 48*a* to charge the capacitor, and turning on the SCR to discharge the capacitor through the fixture 38. The unipolar circuit also includes a shunt diode 52, sometimes called a "flyback" diode.

Figure 6A:
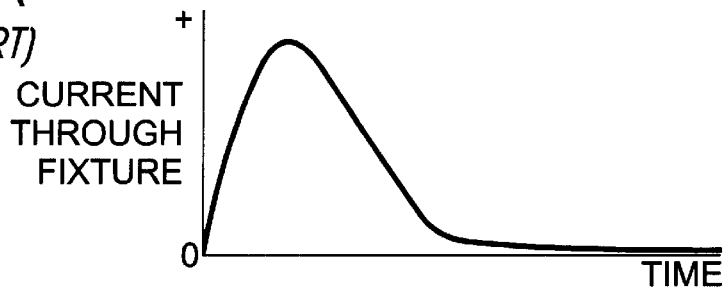
Fig. 6A (PRIOR ART)
FIG. 6A illustrates the magnetization current waveform produced by the driving system of FIG. 5.
Figure 6B:
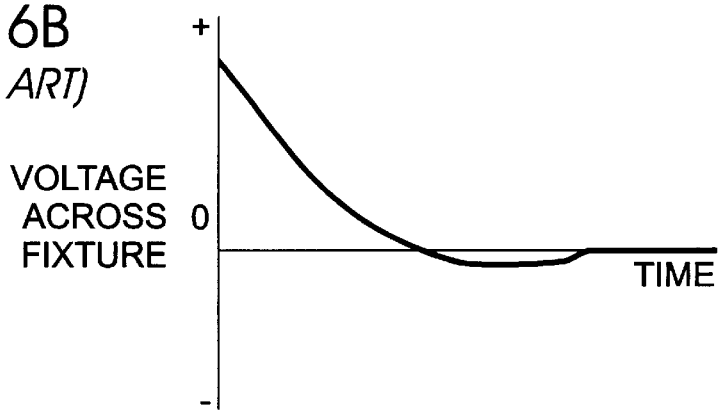
Fig. 6B (PRIOR ART)
FIG. 6B illustrates the voltage produced across the magnetizing fixture by the prior art driving system of FIG. 5.

When the SCR 44*a* turns on, the current through the fixture 38 varies as shown in FIG. 6A. The voltage across the fixture 38, varies as shown in FIG. 6B.

Neither of these circuits is entirely satisfactory. Since the rate of change of current through the fixture is not constant, resistive heating limits the amount of current that could ideally be applied to the fixture. This, in turn, limits the magnetization that can be produced in an article to be magnetized.

Figure 7A:
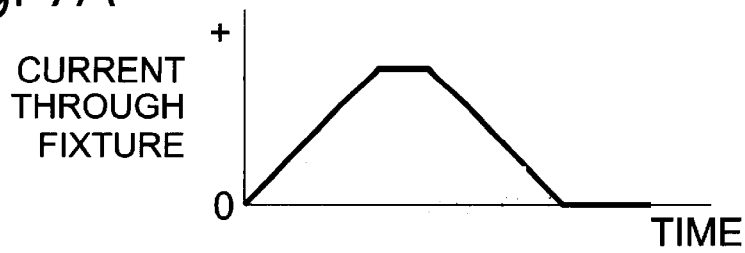
FIG. 7A is an illustration of an ideal magnetization current waveform.
Figure 7B:
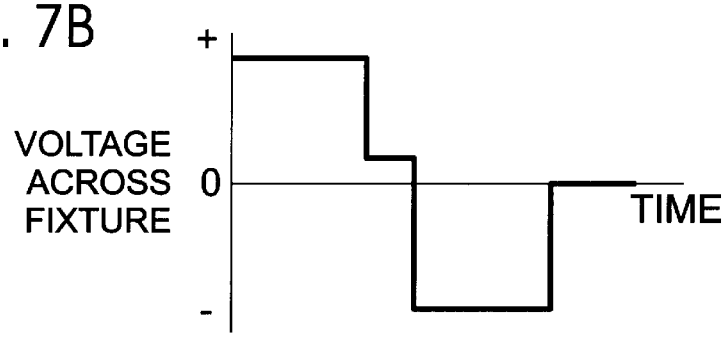
FIG. 7B is an illustration of an ideal waveform of voltage across a magnetizing fixture.

The ideal current waveform for a magnetizing fixture is shown in FIG. 7A. The ideal voltage waveform is shown in FIG. 7B. As shown in FIG. 7A, the current would first ramp up linearly to its maximum value, then remain constant for a short time for eddy currents to die out, then ramp down to zero linearly. Since the voltage across the fixture is proportional to L di/dt−iR, the voltage would remain at a constant positive value while the current is ramping up, then drop nearly to zero while the eddy currents die out, then drop to a constant negative value while the current ramps down, as shown in FIG. 7B. The slight positive voltage when the current through the fixture is constant is a consequence of the resistance R of the magnetizing fixture.

While the ideal current waveform cannot be perfectly achieved, it can be closely approximated by the magnetizing fixture driving system and method of the present invention, as described hereafter.

Figure 8:
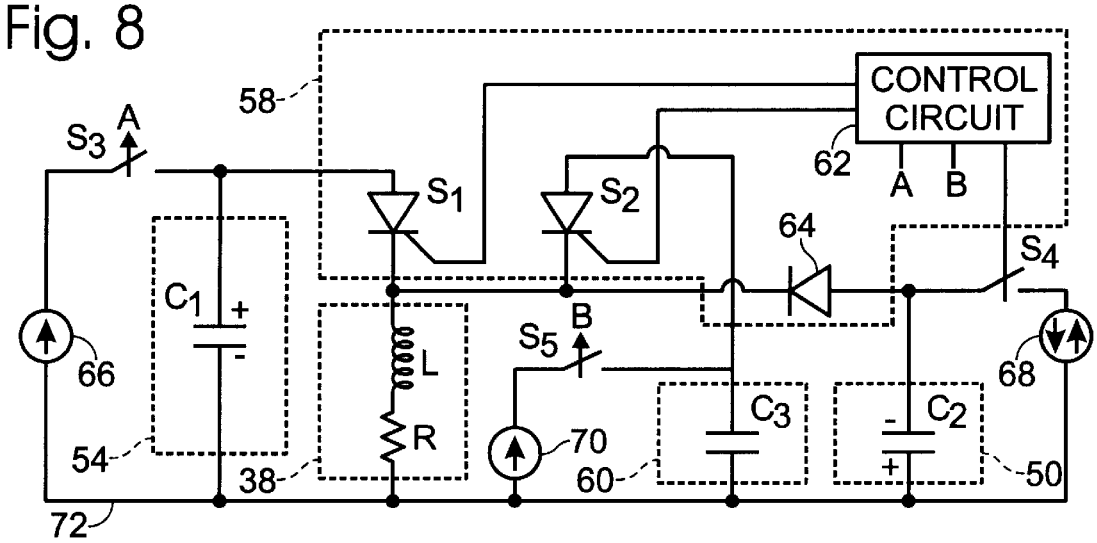
FIG. 8 is a schematic diagram of a preferred embodiment of a magnetizing fixture driving system according to the principles of the present invention.

FIG. 8 shows a preferred embodiment of a magnetizing fixture driving system according to the present invention. That embodiment shows that the driving system comprises a first energy storage device 54 for supplying electrical energy to the magnetizing fixture 38, a second energy storage device 56 for receiving electrical energy from the magnetizing fixture 38, and a commutator 58 for stopping the flow of electrical energy into the magnetizing fixture from the first energy storage device 54 and starting the flow of energy from the magnetizing fixture into the second energy storage device 56. The driving system also includes a third energy storage device 60 for supplying additional electrical energy to the magnetizing fixture to assist in stopping the flow of energy from the first energy storage device 54 and starting the flow of energy into the second energy storage device 56; however, the third energy storage device may not be needed, depending on the nature of the switching components actually used in the driving system, and the invention is not limited thereby.

More specifically, in the preferred embodiment, the first energy storage device. 54 comprises a capacitor C1 and the second energy storage device 56 comprises a capacitor C2. The commutator 58 comprises the third energy storage device 60, which itself comprises a capacitor C3, a first electronic switch S1, a second electronic switch S2, and a control circuit 62 for operating the system. The switches S1 and S2 are preferably triggered power rectifiers, such as SCRs or ignitrons, and are triggered by the control circuit 62. A diode 64 is disposed between capacitor C2 and the fixture 38 to ensure that energy flows in the right direction.

The system also comprises a first charging circuit 66 for providing the first energy storage device 54 with energy, more specifically charging capacitor C1, and a switch S3 for connecting the first charging circuit 66 to the first energy storage device 54. The system further comprises a second charging circuit 68 for transferring energy to and from the second energy storage device 56, that is, charging and discharging capacitor C2, and a switch S4 for connecting the second charging circuit 68 to the second energy storage device 56. The system also comprises a third charging circuit 70 for transferring energy to the third energy storage device 60, that is, charging capacitor C3.

Switches S3, S4 and S5 are preferably operated by the control circuit 62. The trigger provided to S2 is floating, as is well understood in the art.

Operation of the preferred system of FIG. 8 is now explained with reference to FIGS. 9A–9E. Initially, S3 is closed to charge capacitor C1 to voltage V1, switch S4 is closed to charge capacitor C2 to voltage V2, which is negative with respect to reference 72, and S5 is closed to charge capacitor C3 to voltage V3. Then, switches S3, S4 and S5 are opened, leaving the capacitors C1, C2 and C3 charged.

Thereafter, at the beginning of time t1, the control circuit 62 initiates a magnetization cycle by triggering switch S1, an SCR, which is thereby cause to conduct and discharge capacitor C1 through the fixture 38. The voltage across the fixture is initially slightly less than V1, that is less by the voltage drop across the SCR S1, and decreases only slightly for time t1, as shown by FIG. 8E, while the current through the fixture ramps up nearly linearly, as shown by FIG. 8D.

Once the SCR S1 begins to conduct, it cannot be shut off unless its polarity is reversed. But to ensure that the current ramps up nearly linearly, the capacitor C1 cannot be allowed to discharge fully, so the SCR must be shut off at a point well before the capacitor C1 is fully discharged. The control circuit accomplishes this by turning on SCR S2 at the beginning of time t3, which discharges capacitor C3 into the fixture 38 and reverse biases SCR S1, thereby shutting off SCR S1.

Capacitor C3 has a lower capacitance than capacitor C1. Therefore, it discharges completely in a relatively short time, and thereafter begins to charge in the opposite direction as the field in the magnetizing fixture begins to collapse. Although the current is not constant over time t3, it is nearly so, within some predetermined amount ΔI, so that, as a practical matter, any eddy currents in the fixture can die out before the current begins ramping down at a substantially constant rate.

Figures 9A, 9B, 9C, 9D, 9E:
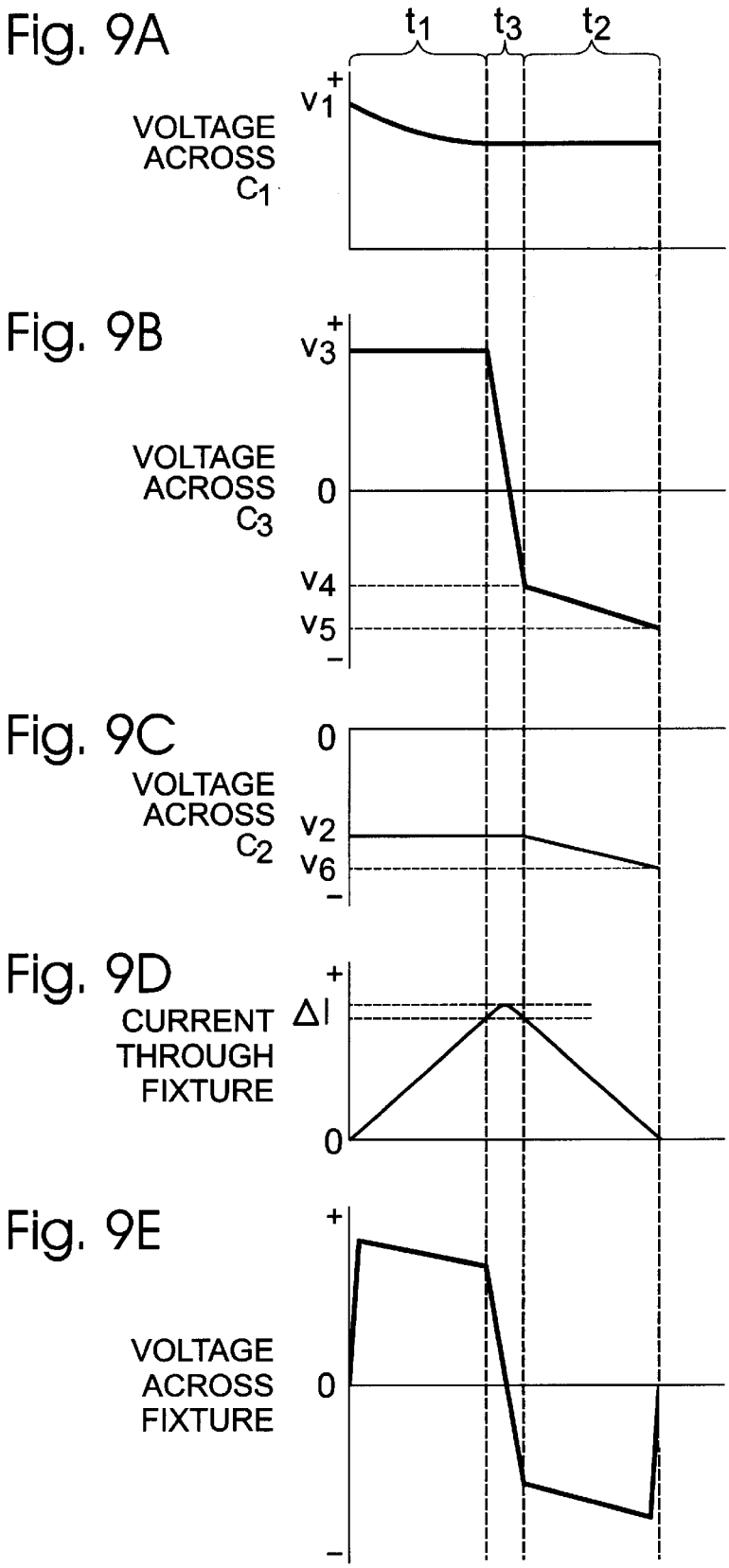
FIG. 9A illustrates the voltage across a first energy storage device in the system of FIG. 8 as a function of time.
FIG. 9B illustrates the voltage across a third energy storage device in the system of FIG. 8 as a function of time.
FIG. 9C illustrates the voltage across a second energy storage device in the system of FIG. 7 as a function of time.
FIG. 9D illustrates the magnetization current produced in a magnetizing fixture by the system of FIG. 8.
FIG. 9E illustrates the voltage produced across a magnetizing fixture by the system of FIG. 8.

Diode 64 remains reverse biased until capacitor C3 is charged to a negative V4. At that point, diode 64 begins to conduct and the collapsing magnetic field in the fixture begins charging C2 as well as C3 until the field has completely collapsed, at which point the voltage across C3 is V5, as shown by FIG. 9B, and the voltage across C2 is V6, as shown by FIG. 9C. That essentially represents the end of time t2. Both V5 and V6 are negative with respect to the reference 72. With no further circuit in L to cause a negative voltage drop across it, both diode 64 and SCR S2 stop conducting, as they are reverse biased. The magnetization cycle is then complete, though the control circuit 62 must return C1, C2 an C3 to their initial conditions using charging circuits 66, 68 and 70.

Referring specifically to FIG. 9E, the voltage across the fixture 38 drops slowly during time t1, but remains effectively constant. During time t3, it actually ramps rapidly to a low negative value, slightly less negative, by the voltage across SCR S2, than voltage V4. This is because the current through the fixture during time t3 is not actually constant and because of eddy currents that are changing as well. Then, the voltage across the fixture slowly becomes more negative, but remains effectively constant during time t2, ending at a voltage slightly less negative, by the voltage across diode 64, than voltage V6.

While a specific drive circuit has been shown in the preferred embodiment of FIG. 8, it is to be recognized that other circuits and electronic components could be employed without departing from the principles of the invention. The essence of the invention is in supplying energy to the magnetizing fixture from a first energy storage device so as to ramp the current in the fixture up at a substantially constant rate, then transferring the energy in the magnetic field of the fixture to a second energy storage or absorption device so as to ramp the current down at a substantially constant rate.

Figure 10:
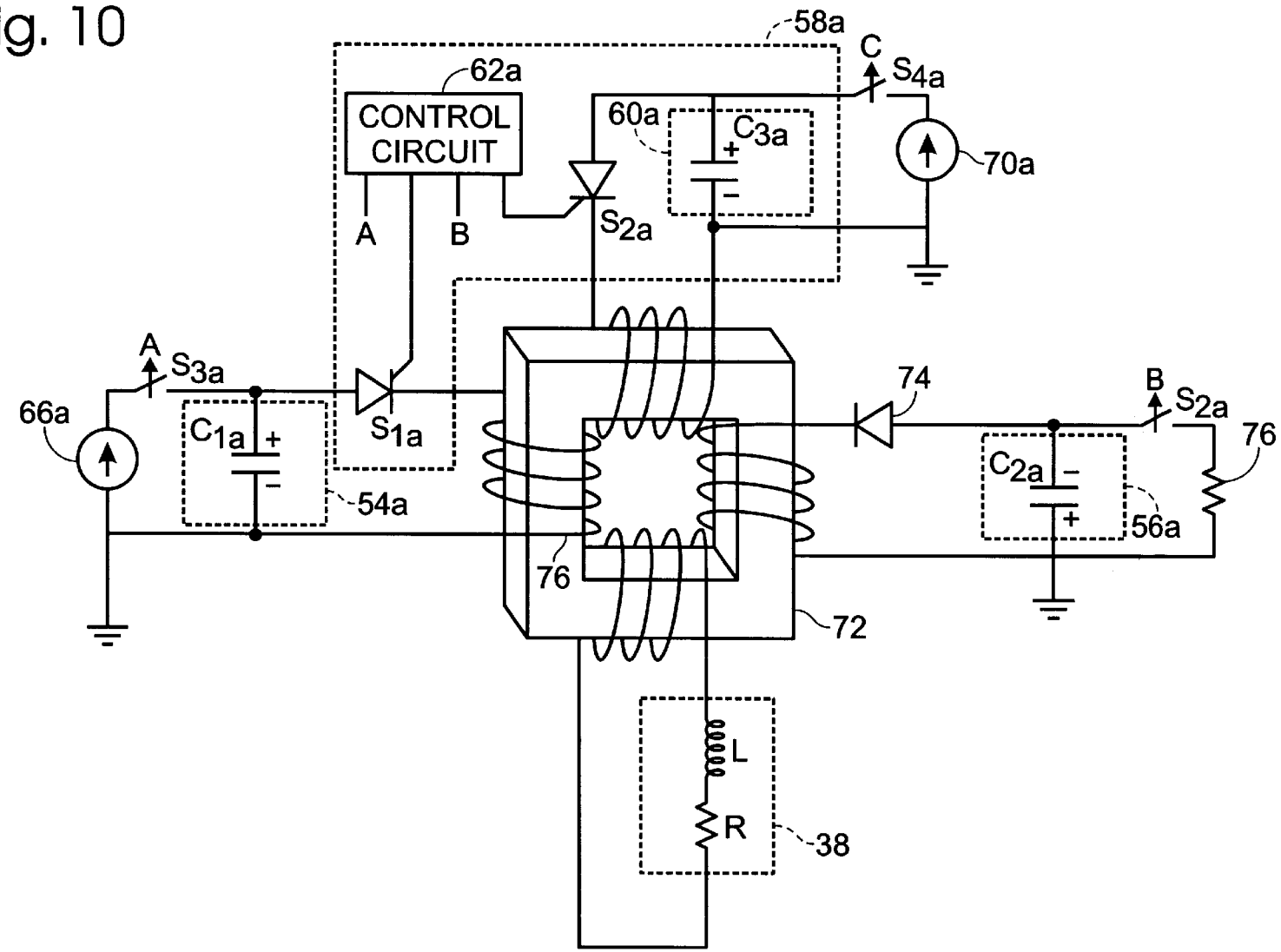
FIG. 10 is a schematic diagram of an alternative embodiment of a magnetizing fixture driving system according to the principles of the present invention.

Indeed, a second, alternative embodiment of the invention is shown in FIG. 10. The second embodiment is analogous in operation to the above-described first, preferred embodiment, but is transformer coupled and has a few specific circuit differences as described hereafter. Thus, the second embodiment includes a first energy storage device 54*a*, a second energy storage device 56*a*, and a commutator 58*a*. The commutator includes a third energy storage device 60*a*, a control circuit 62*a*, a first switch S1*a* and a second switch S2*a*. In addition, the second embodiment employs a first charging circuit 66*a* and associated switch S3*a* and a third charging circuit 70*a* and associated switch S4*a*. The control circuit provides floating triggers to switches S1*a*, S2*a* and S3*a*. These elements perform essentially the same functions in the second embodiment as in the corresponding elements in the first embodiment.

The essential difference between the first embodiment and the second embodiment is that the first, second and third energy storage devices are coupled to the magnetizing fixture 38 by a transformer 72. Operationally, this means that there may be no need for a second charging circuit, depending on the number of turns in the transformer coils. When current is produced in the transformer winding 76 by releasing energy from capacitor C1*a*, that current not only induces current through the magnetizing fixture, but also induces current that charges capacitor C2*a*. Then, the energy stored in the inductor L of the magnetizing fixture is released into the capacitor C2*a* through diode 74 once the voltage across the magnetizing fixture 38 becomes negative. Thereafter, the energy in the capacitor C2*a* is discharged into resistor 76 by switch S2*a*, under control of the control circuit 62*a*.

Figure 11:
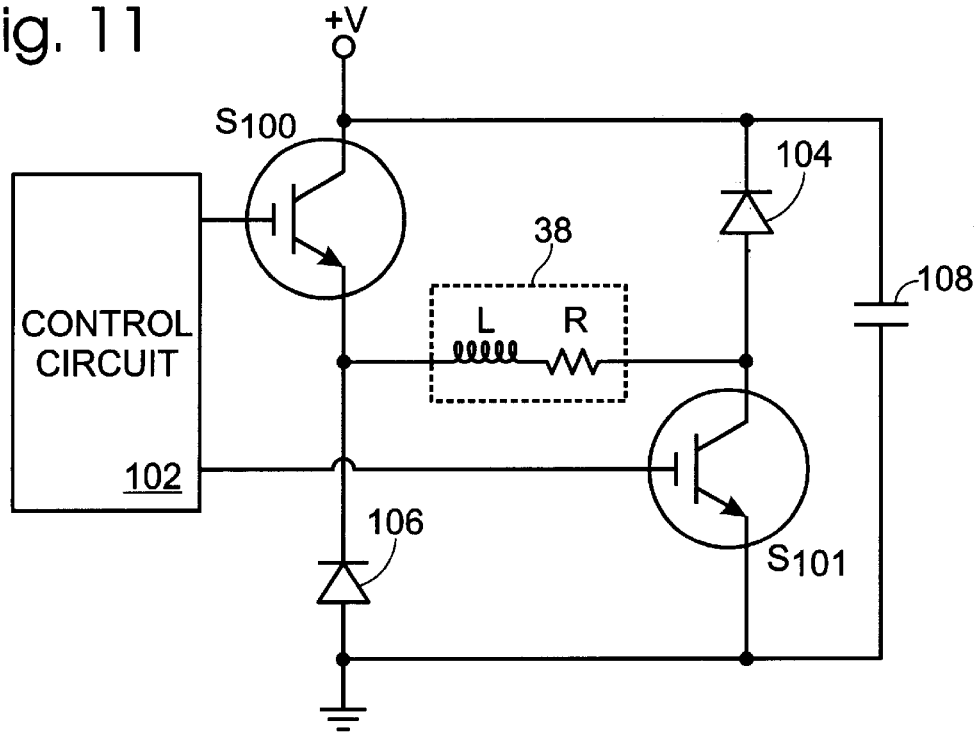
FIG. 11 is a schematic diagram of another alternative embodiment of a magnetizing fixture driving system according to the principles of the present invention.

FIG. 11 shows a second preferred embodiment of a magnetizing fixture driving system according to the present invention. That embodiment shows that the driving system comprises a substantially constant voltage source +V and two switches S100 and S101 controlled by a control circuit 102, and diodes 104 and 106 to produce the aforementioned substantially triangular current waveform through the magnetizing fixture 38. The switch S100 and the diode 104 each have one side thereof connected to +V, while the switch S101 and the diode 106 each have one side thereof connected to ground.

Figure 12A:
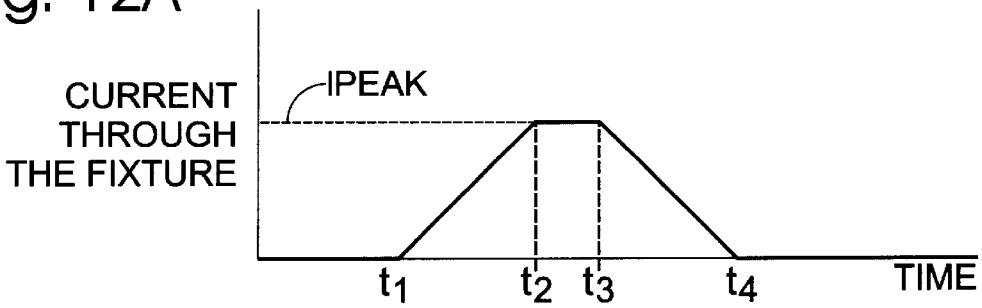
FIG. 12A illustrates the current produced in a magnetizing fixture by the system of FIG. 11.
Figure 12B:
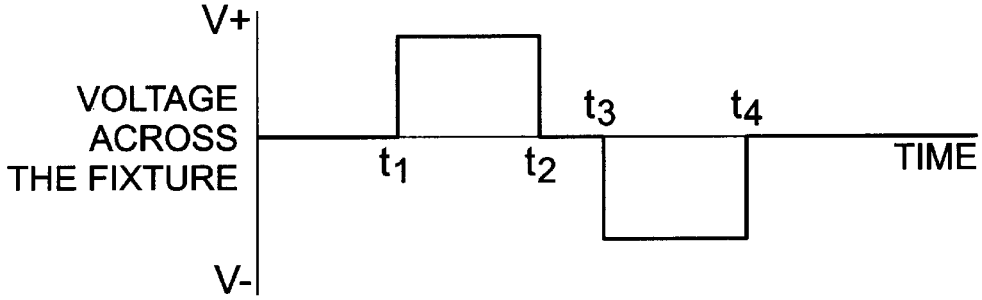
FIG. 12B illustrates the voltage produced across a magnetizing fixture by the system of FIG. 11.

The circuit operates as follows, with additional reference to FIGS. 12A and 12B. At time $t_1$, S100 and S101 are turned on by the control circuit 102. Current through the fixture 38 flows positively from the voltage source through S100, into the fixture, and out S101 to ground. For large values of V, the voltage drops across S100 and S101 and the internal resistance of the magnetizing fixture are negligible and a substantially constant voltage of value +V is applied across the fixture, the current being allowed to ramp up linearly to a predetermined peak value $t_{peak}$, at time $t_2$.

At $t_2$, S101 is turned off, while S100 remains on. The current continues to flow from the source through S100 and into the fixture, but is now passed through the diode 104 into the capacitor 108 to complete the circuit. By conduction through S100 and the diode 104, the voltage across the fixture is immediately held at zero, and the current through the fixture is permitted to change insubstantially over a time interval $t_2$–$t_3$.

At $t_3$, S100 is turned off, while S101 remains off. The current is now supplied through the diode 106 to the fixture, and continues to flow out the diode 104 into the capacitor 108 to complete the circuit. By conduction through the diodes 104 and 106, the voltage across the fixture is immediately held at −V and, in response, the current ramps down linearly and back to zero, at $t_4$.

The switches S100 and S101 must be able to switch off large values of current, e.g., 100 amperes are more, and are typically three junction devices rather than transistors, which are two junction devices. The switches are in the class of devices that include the preferred IGBT, the GCT and MCT, the latter two being relatively new devices. It should be understood that the circuit contemplates the employment of new devices falling within the class as they become available. As will also be appreciated, the diodes 104 and 106 are merely specific embodiments of switches, which may alternatively be provided as devices of the same class as the switches S100 and S101, and being controlled by the circuit 102 or the like.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. A method for driving a magnetizing fixture adapted to produce a high intensity magnetic field and having an electrically insulated conductor, comprising:

placing an article to be permanently magnetized within the high intensity magnetic field of the magnetizing fixture;

producing in the conductor of the magnetizing fixture for a first period of time a first current whose magnitude increases substantially linearly with time by an amount in excess of 100 amperes;

producing in the conductor of the magnetizing fixture for a second period of time a second current in the same direction as said first current whose magnitude decreases substantially linearly with time; and thereby permanently magnetizing the article.

2. The method of claim 1, wherein said steps of producing said first and said currents produce said currents over a time period that is less than about 0.1 seconds.

3. The method of claim 1, further comprising, between said first period of time and said second period of time, producing in the conductor of the magnetizing fixture for a third period of time a third current in the same direction as said first current whose magnitude is held at substantially the magnitude of said first current at the end of said first period of time, wherein said third period of time is less than half the sum of said first, second and third periods of time.

4. The method of claim 1, wherein said step of producing said first current causes said first current to rise from a starting value, and wherein said step of producing said second current causes said second current to decrease substantially to said starting value.

* * * * *